US010479583B1

(12) United States Patent
Werny

(10) Patent No.: US 10,479,583 B1
(45) Date of Patent: Nov. 19, 2019

(54) METHOD AND APPARATUS FOR KEEPING INSECTS OUT OF SHIPMENT LOADS

(71) Applicant: Rengo Packaging, Inc., Kapolei, HI (US)

(72) Inventor: Scott Hermann Werny, Honolulu, HI (US)

(73) Assignee: Rengo Packaging, Inc., Kapolei, HI (US)

( * ) Notice: Subject to any disclaimer, the term of this patent is extended or adjusted under 35 U.S.C. 154(b) by 0 days.

(21) Appl. No.: 15/587,013

(22) Filed: May 4, 2017

Related U.S. Application Data

(60) Provisional application No. 62/333,090, filed on May 6, 2016.

(51) Int. Cl.

| | |
|---|---|
| ***B65D 81/24*** | (2006.01) |
| ***B65D 19/00*** | (2006.01) |
| ***B65D 19/38*** | (2006.01) |
| ***B65D 71/00*** | (2006.01) |
| ***B65D 85/34*** | (2006.01) |

(52) U.S. Cl.
CPC ..... *B65D 81/24* (2013.01); *B65D 19/0095* (2013.01); *B65D 19/38* (2013.01); *B65D 71/0096* (2013.01); *B65D 85/34* (2013.01); *B65D 2519/00273* (2013.01); *B65D 2519/00293* (2013.01); *B65D 2519/00323* (2013.01); *B65D 2519/00333* (2013.01)

(58) Field of Classification Search
CPC .... B65D 81/24; B65D 19/0095; B65D 19/38; B65D 71/0096; B65D 85/34; B65D 2519/00273; B65D 2519/00293; B65D 2519/00323; B65D 2519/00333
USPC ..... 206/386, 597
See application file for complete search history.

(56) References Cited

U.S. PATENT DOCUMENTS

| | | | | |
|---|---|---|---|---|
| 3,429,095 | A * | 2/1969 | Huson | B65B 63/028 100/25 |
| 4,000,815 | A * | 1/1977 | Wingbro | B65D 19/38 206/205 |
| 4,149,755 | A * | 4/1979 | Handleman | B65D 88/72 137/527.8 |
| 4,292,901 | A * | 10/1981 | Cox | B65D 71/0096 108/55.1 |
| 4,513,907 | A | 4/1985 | Grosshuesch | |
| 6,907,712 | B2 | 6/2005 | Garfinkle | |
| 7,127,753 | B1 * | 10/2006 | Ramaley | A47G 9/086 5/413 R |
| 7,222,740 | B2 | 5/2007 | Garfinkle | |

(Continued)

*Primary Examiner* — Chun Hoi Cheung
(74) *Attorney, Agent, or Firm* — Watanabe Ing LLP

(57) ABSTRACT

An apparatus and method for storing and transporting a load (12) of goods, having been treated or fumigated for insects. The apparatus comprises a bag (10) and a sealing means (14) that seals bag once load (12) is inserted. All or a portion of bag 10 is made with netting, screen, or other porous material (13) that keep insects out of bag (10) but allow for sufficient ventilation of load (12). Bag (10) may be a single piece or multiple pieces and the location of porous material (13) on bag (10) may vary depending on the type of goods contained in load (12). The apparatus may also contain securement means (24) that help hold load (12) in place. The method comprises loading, sealing, transporting, and unloading goods using the described apparatus.

18 Claims, 10 Drawing Sheets

(56) References Cited

U.S. PATENT DOCUMENTS

| | | | | |
|---|---|---|---|---|
| 7,900,775 | B2 * | 3/2011 | Hojholt | B65D 71/0088 206/597 |
| 2002/0078661 | A1 * | 6/2002 | Bowden | B65B 11/025 53/397 |
| 2003/0168449 | A1 * | 9/2003 | Garfinkle | B65D 19/06 220/1.5 |
| 2005/0171812 | A1 | 8/2005 | Garfinkle et al. | |
| 2009/0288980 | A1 * | 11/2009 | Hadala | B65D 71/0096 206/597 |
| 2014/0138281 | A1 * | 5/2014 | Emond | B65D 71/0088 206/597 |
| 2016/0001922 | A1 * | 1/2016 | Sadykov | B65D 19/38 53/414 |

* cited by examiner

METHOD AND APPARATUS FOR KEEPING INSECTS OUT OF SHIPMENT LOADS

CROSS-REFERENCE TO RELATED APPLICATIONS

This U.S. Non-Provisional Utility Patent Application claims the benefit, under 35 U.S.C. § 119, of U.S. Provisional Patent Application No. 62/333,090 filed May 6, 2016 by the present inventor, the contents of which are incorporated herein in their entirety.

STATEMENT REGARDING FEDERALLY SPONSORED RESEARCH

The invention described herein was not made pursuant to a government agency grant or contract. No government funds were utilized in the described invention.

FIELD OF THE INVENTION

The present invention relates to a method and apparatus for storage and transport of goods. In particular, the present invention is a method and apparatus that prevents insects from entering shipments of goods during storage and transport.

BACKGROUND OF THE INVENTION

Consumers desire fresh fruits, vegetables, floral items, and other products to be available for purchase all year round, even when those desired products are not in season or not grown or produced in the geographical region where that particular consumer lives. Food and floral growers, packers, processors, and distributors have attempted to satisfy the consumers' desire by shipping and transporting desired products from around the world.

One obstacle in shipping desired products around the world is preventing live insects, spiders, or other animals from getting into the desired products so as to prevent the spread of these insects, spiders or other animals to geographical areas where these insects, spiders, or other animals do not currently live.

The United States Department of Agriculture ("USDA") is very strict about preventing insects from traveling to another geographic location within the United States and perhaps upsetting the balance of a local ecosystem. For example, there are strict rules governing how produce from geographical areas where fruit flies may exist can be shipped into an area where the fruit fly has been eradicated.

According to current practice, fresh produce is transported to a facility where the produce is fumigated using various insecticides and/or pesticides or irradiated and then sealed in closed shipping boxes, such as corrugated boxes, and loaded into a large shipping container. The container is then sealed after the shipping boxes are loaded. Once the produce is treated with gas, irradiation, or other method, such that no insects, insect eggs, or their larvae are in or around the goods, the goods must remain in a sealed container and the packer, processor, and/or distributor is unable to reopen the shipping container until it is shipped and reaches its final destination.

If the sealed container is opened, the entire process must be redone. Specifically, these goods must be transported back to the treatment facility, removed from the shipping container, fumigated, reloaded into the shipping container, and sealed again, incurring significant expense, unnecessary effort and delay.

Also according to current practice, the produce needs to be shipped in sealed boxes or other sealed containers to keep the insects out. However, sealed shipping boxes cannot be used in warehouse club stores, which have strict rules that require the packaging to clearly show the product. Because of this, there are certain fruits, particularly those that require fumigation prior to shipment, that currently are not sold in warehouse club stores.

The present invention overcomes the drawbacks and shortcomings of the conventional methods described above by providing a quick and inexpensive way to keep insects, spiders, or other animals from reaching the packed product even if a shipping container remains open, or if a sealed shipping container is opened. The present invention eliminates the need, should a container become opened, to transport the items back to the treatment facility, to remove the goods from the shipping container, to have the goods fumigated again, to reload the goods into the shipping container, and to reseal the container.

In addition to being effective in preventing bugs from reaching or traveling with the product, the present invention when used with open or vented produce containers, allows for ventilation, which is particularly important when shipping fruits, vegetables, floral products, or other products. With ventilation it is possible to maintain the goods in a controlled environment at a desired temperature and relative humidity level, and to allow the introduction and escape of gas to quicken or slow ripening.

Instead of sealing each and every box individually from insects, the present invention allows the use of packaging that may have open tops and venting cutouts, by causing the entire pallet-load to be sealed from insects. This type of packaging allows the fruit to be visible and available for shipment and sale in warehouse club stores.

Furthermore, the present invention reduces the amount of handling that some goods, such as produce, may need by eliminating the need for the inspection of the actual fruit by USDA inspectors to determine if unwanted insects are present.

The present invention also allows customers to inspect the quality of the fruit without opening each and every box.

The foregoing and other objects, features and advantages of the invention will be apparent from the following more particular description of a preferred embodiment of the invention, as illustrated in the accompanying drawings wherein like reference numbers represent like parts of the invention.

SUMMARY OF THE INVENTION

The present invention is a method and apparatus for keeping insects out of pallet load shipments using a one-piece or multi-piece bag, where all or a portion of the bag is made of screen, netting, or other porous or vented material. In a preferred embodiment of apparatus, the bag consists of a bottom sheet and top cover.

To use the apparatus, the load of product is placed onto the bottom sheet, the top cover is placed over the load, and the edges of the top cover are sealed to the edges of the bottom sheet.

One aspect of the instant invention is an apparatus in the form of an enclosure with at least once section fabricated of screen, netting, or other porous, permeable or venting material having pores so as to allow air flow across the enclosure and into the load but small enough to keep insects and other pests out of the enclosure and load.

A second aspect of the instant invention is an apparatus that contains a sealing means that seals the bag fully closed after the load is inserted into the bag keeping undesired insects out of the bag.

A third aspect of the instant invention is an apparatus where the sealing means is also tamper proof or tamper evident to discourage accidental or unauthorized opening.

A fourth aspect of the instant invention is an apparatus where portions of the apparatus that directly touch the products being shipped in the load are made from solid, non-porous and non-permeable materials.

A fifth aspect of the instant invention is an apparatus that can be reused, if the apparatus is not damaged during the handling or transfer of the load.

A sixth aspect of the instant invention is an apparatus that is used with vented containers that hold the load of goods or with containers having voids that allow the goods to breathe and be seen.

A seventh aspect of the invention is an apparatus that provides for the fast removal of a portion of the apparatus that is being used to protect the load as it requires only the breaking of the tamper evident means, if any, and the unsealing of the sealing means.

An eighth aspect of the invention is a method for applying said apparatus in the manner stretch wrap is currently wrapped around a load, either by machine or by hand.

A ninth aspect of the instant invention is a method for keeping insects out of pallet load shipments using the apparatus described herein.

These and further aspects and other objects and features of the invention are apparent in the disclosure, which includes the above and ongoing written specification, drawings and claims.

DETAILED DESCRIPTION OF PREFERRED EMBODIMENTS

The invention is a method and apparatus for sealing a load of items to be transported, preventing insects or other animals from entering the load, yet still providing ventilation and visibility of the items.

Figure 2:
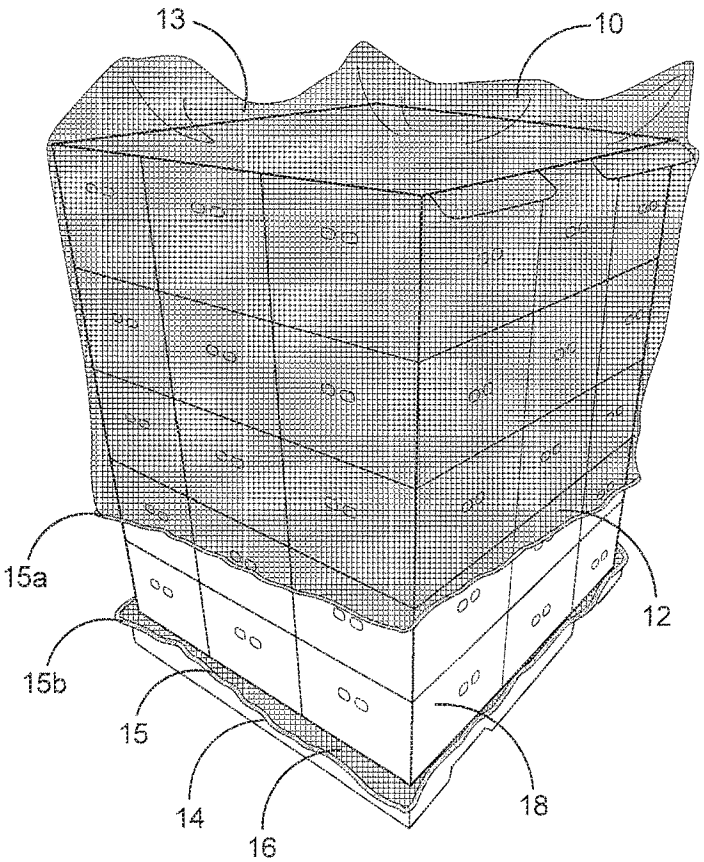
FIG. 2 is a perspective view of one embodiment of the apparatus of the subject invention containing the load in an unsealed state.
Figure 1:
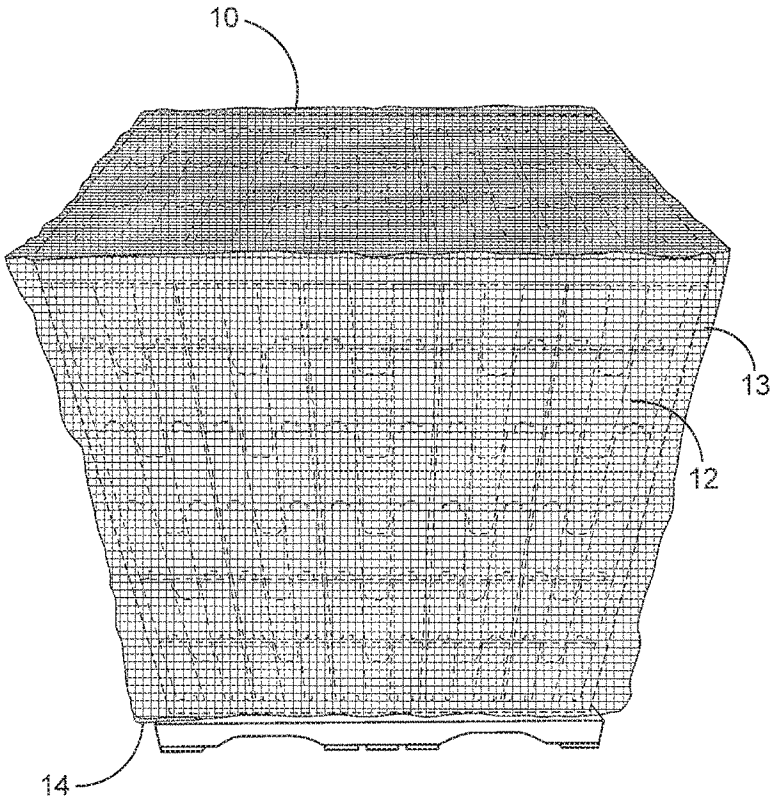
FIG. 1 is a perspective view of one embodiment of the apparatus of the subject invention containing a load sealed within said apparatus.

Referring first to FIGS. 1 and 2, the present invention comprises a single or multiple piece bag 10 made of screen, net, or other breathable or vented material 13 that encases a load 12 of produce or other product, that may have already been treated to remove or kill any insects that may have been in, on, or near the product being shipped. Vented material 13 of bag 10 has small enough holes and a sufficient sealing means 14 for keeping insects or other pests from entering load 12 before, during, and after shipment, yet can still provide some level of ventilation for maintaining the goods and/or visibility for inspection.

Bag 10 may be constructed entirely of vented material 13 as shown in FIGS. 1 and 2, or only portions of bag 10 may be made from vented material 13 with the remainder of bag 10 being of continuous or impermeable material. The placement of material 13 in bag 10 may be varied depending on the level of ventilation, durability, and visibility needed at specific locations of the load 12 that bag 10 encloses.

Examples of types of sealing means 14 that may be used are zippers, hook and loop fastener strips (Velcro), snaps, buttons, tape, glue, staples, stitching, tacks, nails, screws, and/or any combination thereof.

Figure 3A:
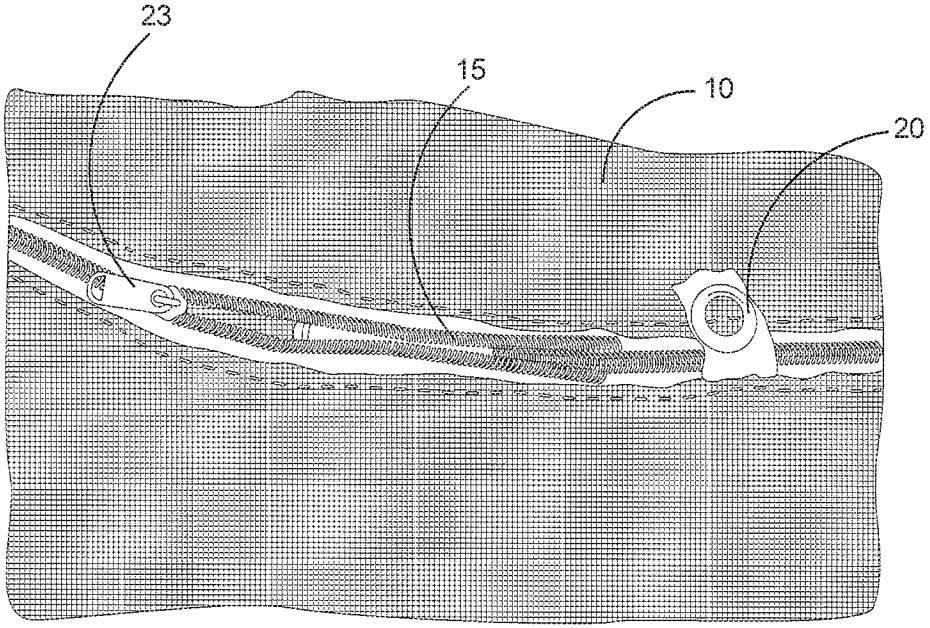
FIG. 3A is a front view of a section of the apparatus showing details of the resealable sealing means used to seal and unseal the apparatus around a load as shown in FIG. 2.
Figure 3B:
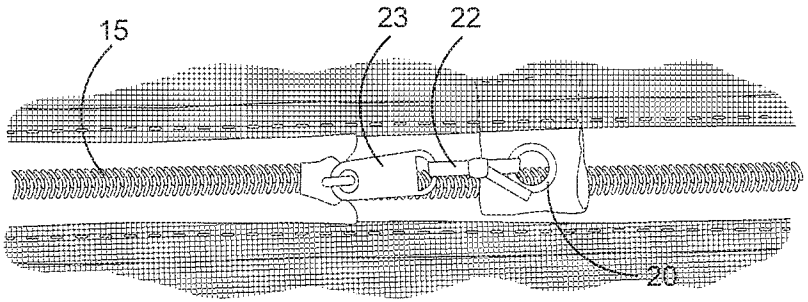
FIG. 3B is an enlarged illustration of a section of the sealing means depicted in FIG. 2 showing details of the tamper evident aspect of said sealing means.

Sealing means 14 can also be tamper evident to discourage accidental and/or unauthorized opening. In FIG. 2, sealing means 14 is a zipper 15. Referring to FIGS. 3A and 3B, which illustrate enlargements of zipper 15 in the preferred embodiment illustrated in FIG. 2, zipper 15 overlaps itself such that insects are sealed out of bag 10 when zipper 15 is zipped up. A grommet 20 or a fabric loop can be affixed to bag 10 in a position near the end of zipper 15, such that a zip tie 22 or other tamper evident means that is inserted through grommet 20 and pull tab 23 of zipper 15 would prevent zipper 15 from being unzipped and keep bag 10 from being opened inadvertently or accidentally until tamper evident means 22 is cut or removed.

Alternative tamper evident means could include a sticker or piece of tape used where zipper 15 overlaps with itself. The sticker or piece of tape may be stamped by the USDA inspector when the load is examined and passed for shipping.

Figure 4B:
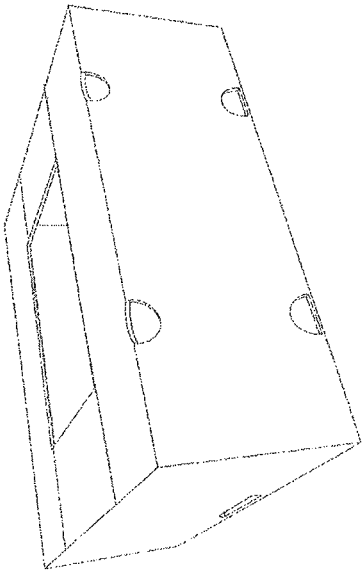
FIGS. 4A through 4F are illustrations of different types and configurations of shipping boxes that can be used to hold and contain the products to be shipped within said apparatus.
Figure 4D:
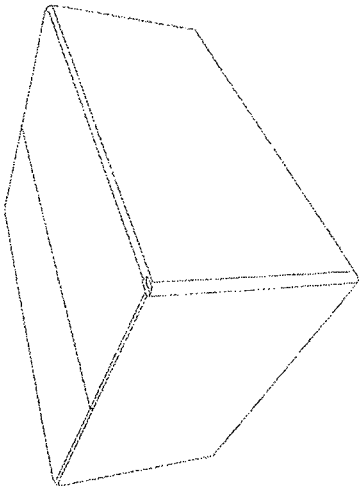
Figure 4A:
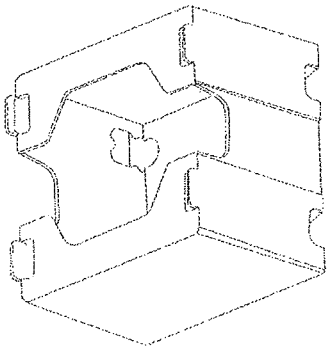
Figure 4C:
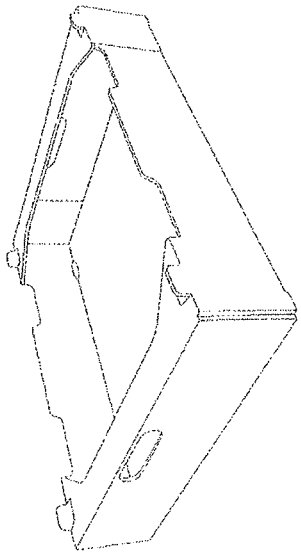
Figure 4F:
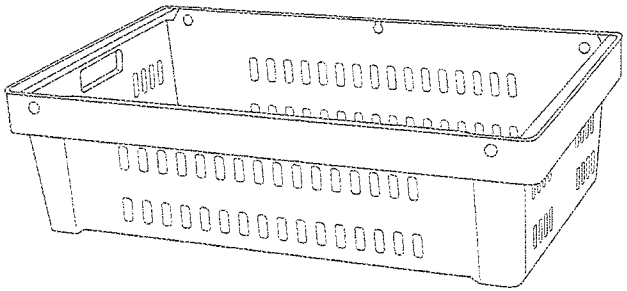
Figure 4G:
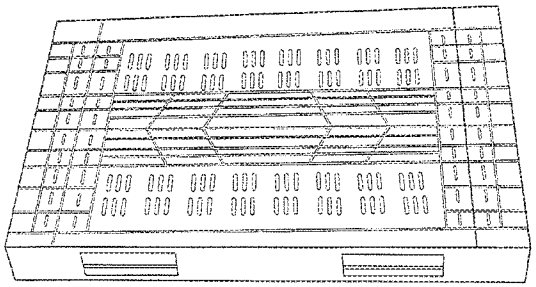
FIG. 4G is an illustration of a box top that could be placed on top of a shipping box, illustrated for example in FIG. 4E.
Figure 4E:
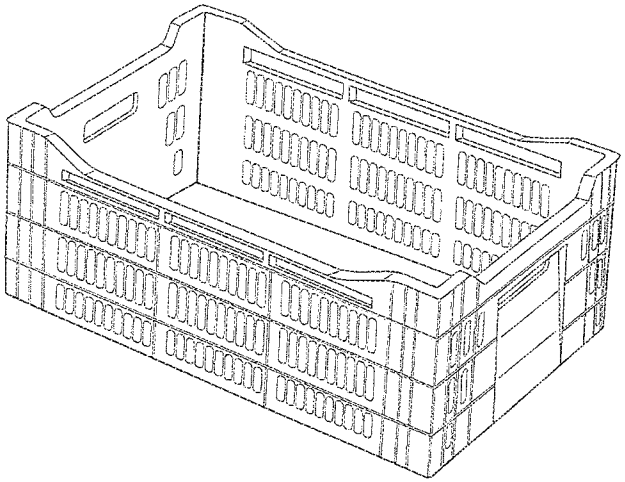

Load 12 can be in one or more containers of any form or material, such as boxes, bags, trays, tubs, bins, crates, cartons, containers, etc., made of paper, plastic, foam, metal, glass, fiber, corrugated cardboard, wood, or any other material. FIGS. 4A through 4F are illustrative examples of different boxes or produce containers that can be used with the invention and that would hold the items comprising load 12. Depicted in FIG. 4G is an example of a box top that could be placed on top of the box illustrated for example in FIG. 4E. The illustrated boxes for the most part have vents or voids to allow sufficient ventilation for the goods being held within the boxes.

The venting material 13 that makes up bag 10 is made of any appropriately sized screen, netting, or material that has holes small enough to let air in, but keep out undesired insects. These hole sizes are noted and required by the USDA, depending on what insect is being kept away from the product being shipped, and the location to where load 12 is being shipped. Also, multiple types of screen may be used to make bag 10, using different colors, different screen or strand thicknesses and/or different hole sizes positioned to keep out different insects or for different items being shipped, all such material and screening being with the scope of the instant invention.

In the preferred embodiment illustrated in FIG. 2, bag 10 is a cube or cuboid shape comprising a bottom sheet 16 and a top piece 18. In FIG. 2, zipper 15 comprises a first side of zipper 15*a* and a second side of zipper 15*b*, such that when first side of zipper 15*a* and second side of zipper 15*b* are aligned and zipped up, both sides connect to form zipper 15. Zipper 15 is used to seal bag 10 around the circumference of bottom sheet 16, where first side of zipper 15*a* is affixed around the perimeter of top cover 18 and second side of zipper 15*b* is affixed to the perimeter of bottom sheet 16.

In other preferred embodiments, portions of bag 10 could be made in part of solid material that has no holes. The USDA may not want the screen to touch the fruit, as there is some possibility that the unwanted insects could reach through the screen and touch the fruit, and perhaps even deposit eggs. Thus, solid material could also be used in areas where the bag may touch the product such as fruit while vented material 13 can be used in other parts where the bag or enclosure does not touch the fruit.

Other methods to prevent the fruit from touching screened or vented portions of the bag or enclosure are using a paper, plastic, corrugated, or other sheet as a spacer in an area of concern. Alternatively, any hole, vent, or gap in the box container that holds the produce may be reduced in the design of the container to keep the screen material from coming in contact with the fruit.

If load 12 is being shipped in a box or other container that has large vents and/or gaps on top, a top sheet made of any appropriate material may be placed on top of the load, and used as a spacer.

One variation of the subject invention is to use a solid plastic sheet material on the bottom and the top of bag 10, while the rest of bag 10 is made of screen material. Another option is to use a stronger and more durable material or screen in the lower area of the sides of bag 10 and/or on the bottom of bag 10, to protect bag 10 from being punctured by lift trucks or anything else during shipment.

A further embodiment includes using three different materials in the construction of bag 10: a solid durable material for the bottom and top of bag 10, a heavy screen for the bottom side areas of bag 10, and a light to medium screen for the top side areas of bag 10.

Figure 5:
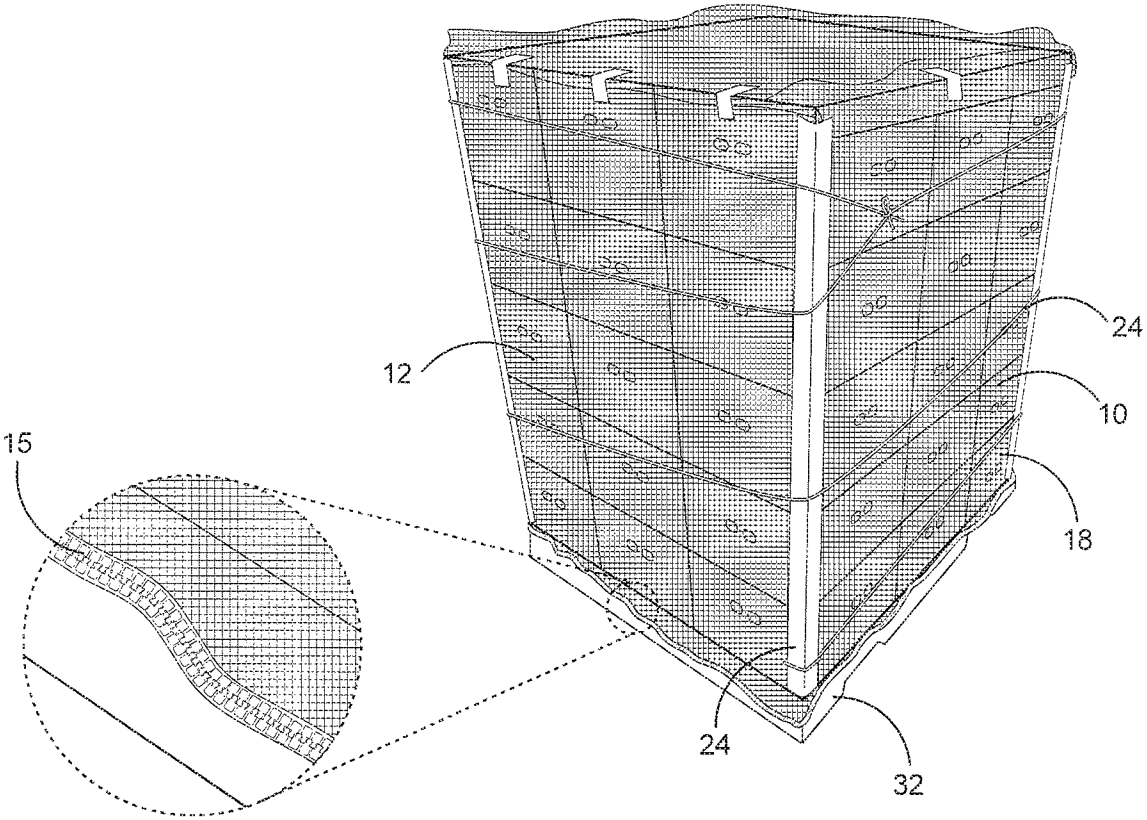
FIG. 5 is a perspective view of one embodiment of the apparatus of the subject invention that includes a securement means comprising rope and corner guards to secure the sealed load and includes an enlarged section of the apparatus to show the details of the securement means.

Load 12 may be held in place using corner-guards, twine, stretch-netting, and/or any other appropriate securement means 24. In FIG. 5, a securement means 24 comprises twine used in conjunction with corner guards. FIG. 5 also includes an enlarged section of the apparatus to show the details of zipper 15.

Elastic, rope, string, tape, stretch wrap, and/or any other means may be used for cinching at any level. These securement means may be sewn onto the bag or used as a separate piece to keep the slack to a minimum, to avoid snags and other damage during shipment. Ideally, bag 10 should not hang below the top edge of the pallet.

Still another embodiment comprises the use of corrugated or other sheets on the outside of bag 10, to protect the sides of bag 10 at the bottom of load 12.

Document holders can also be provided on the outside of bag 10 to allow the user to insert shipping documents. The document holders can be made of transparent material so shipping documents can be read without removing the document from the holder.

Another embodiment encompasses a method where material 13 is on a roll and applied to load 12 the way stretch wrap is currently wrapped around a load, by machine or by hand. Material 13 can be selected to be somewhat stretchy, and the overlap of material 13 would provide a seal.

Bag 10 dimensions are only slightly larger than the pallet stack 32, such that bag 10 does not hang lower than the top edge of pallet 32.

Figure 6B:
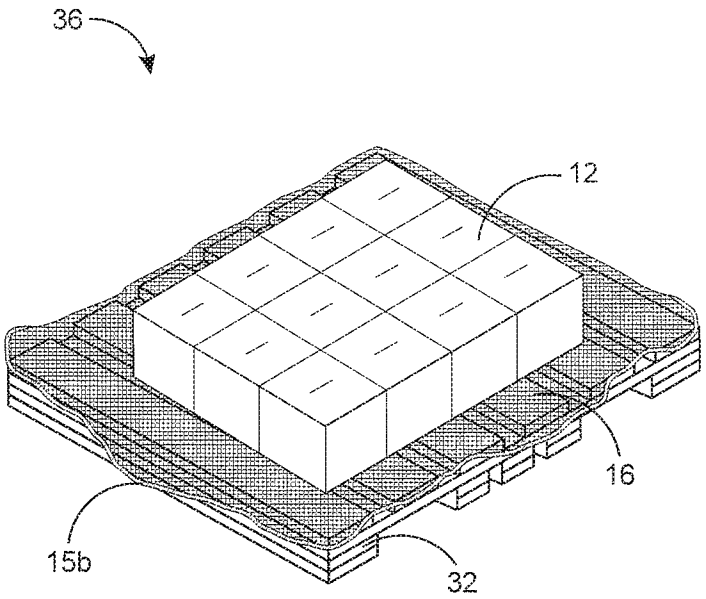
FIGS. 6A through 6F illustrate steps of the method of keeping insects out of pallet load shipments in accordance with a preferred embodiment of the present invention.
Figure 6A:
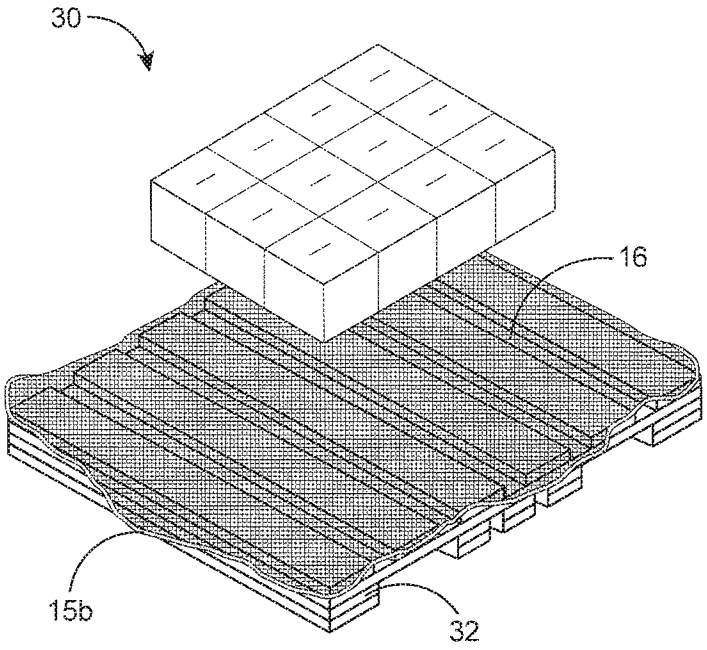

FIGS. 6A through 6F illustrate the method of keeping insects out of load shipments using the apparatus of the present invention described in FIG. 2. As illustrated in FIG. 6A, in the first step 30, bottom sheet 16 is laid down on a pallet 32. As described above, second side of zipper 15*b* is affixed to the entire perimeter of bottom sheet 16.

Figure 6D:
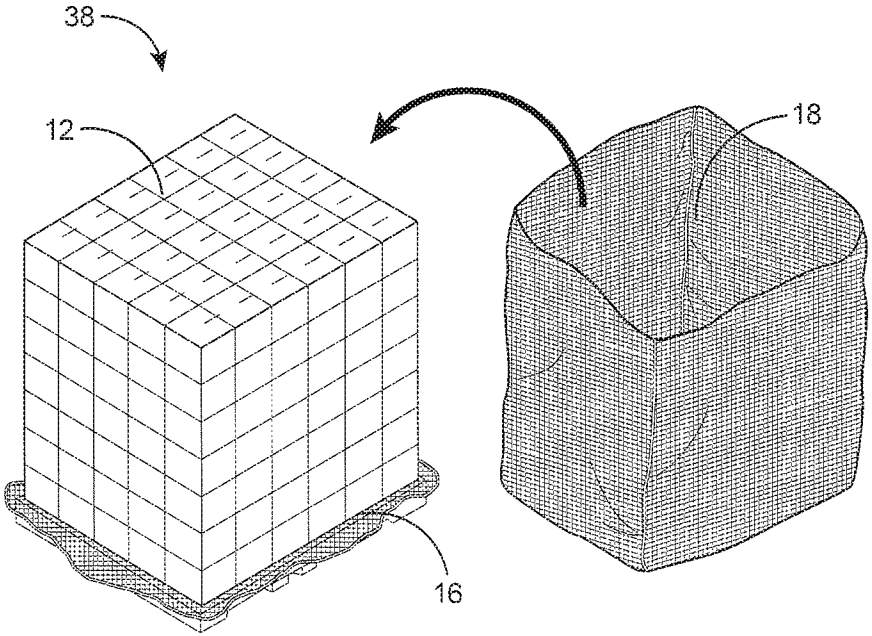
Figure 6C:
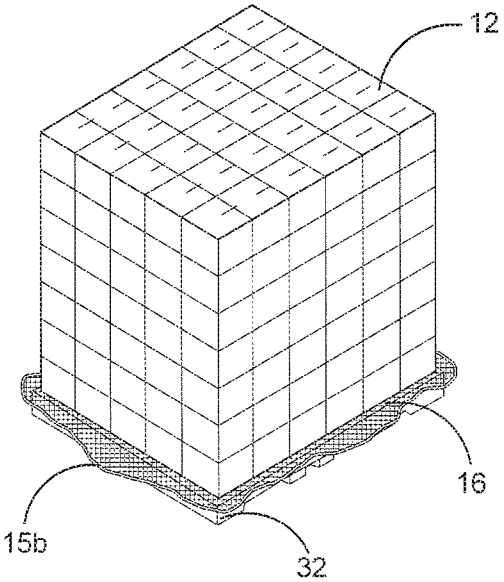

As illustrated in FIGS. 6B and 6C, in the second step 36, load 12 of products being shipped that have already been treated to remove or kill any insects that may be near or on said products are stacked or otherwise placed onto bottom sheet 16 on pallet 32. When load 12 is stacked onto bottom sheet 16, load 12 must fit within the area of bottom sheet 16, leaving the perimeter of bottom sheet 16 and second side of zipper 15*b* unobstructed by load 12.

As illustrated in FIG. 6D, in the third step 38, top piece 18 is slipped over load 12, so that top piece 18 fully encloses load 12 and the perimeter edge on the open end of top piece 18 meets the perimeter of bottom sheet 16.

In the fourth step 40, top piece 18 is sealed to bottom sheet 16 using first side of zipper 15*a* and second side of zipper 15*b*. In the preferred embodiment illustrated in FIG. 6E, first side of zipper 15*a* is aligned with second side of zipper 15*b* so that both sides can be zipped together thereby sealing top piece 18 to bottom sheet 16.

Figure 6F:
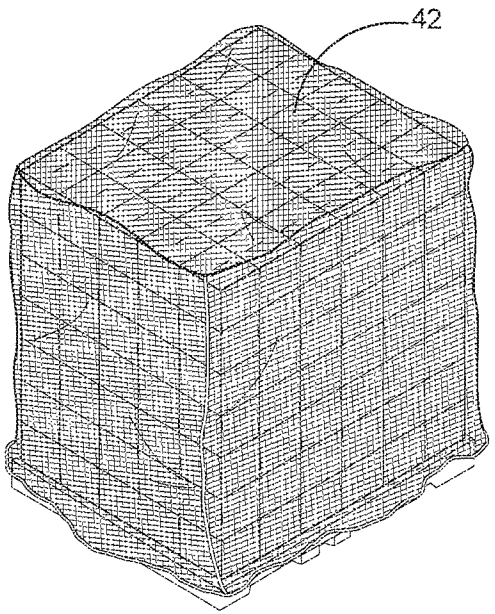
Figure 6E:
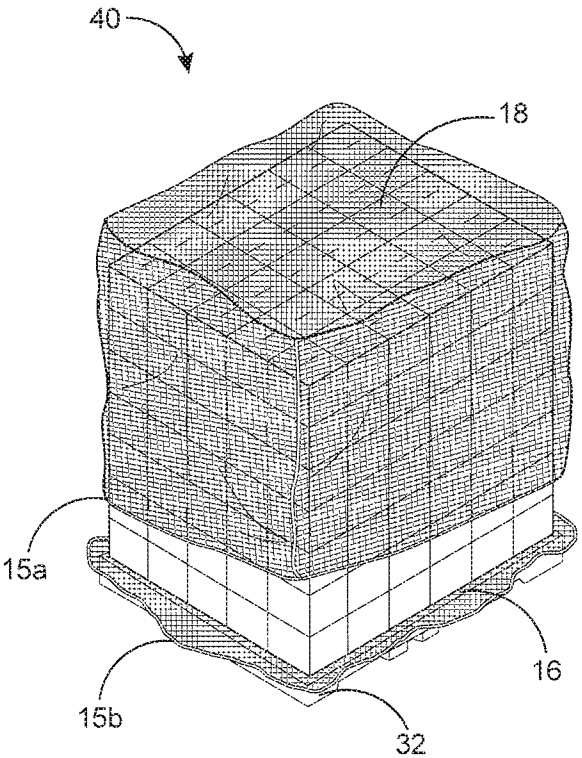

FIG. 6F illustrates the sealed load 42 that is ready for storage and shipping. Sealed load 42 can be transported into a shipping container for shipping to the desired destination.

When the sealed load 42 arrives at the receiving end of the shipment and/or destination, any securement means 24 are undone, zipper 15 is unzipped, and load 12 is unloaded. Alternatively, in a warehouse club store environment, securement means 24 are undone, sealing means 14 is unsealed, and top piece 18 is removed from load 12. Load 12 can be seen and bought by shoppers while bottom sheet 16 of bag 10 will remain on pallet until all products of load 12 are removed and/or purchased by shoppers. Bottom sheet 16 will lie on pallet 32 and is designed to be inconspicuous and not get in the way.

Once all items in load 12 are removed, bottom sheet 16 of bag 10 is removed from pallet 32. At this point, bag 10 may be reused, if inspected and found to be free of damage.

Figure 7B:
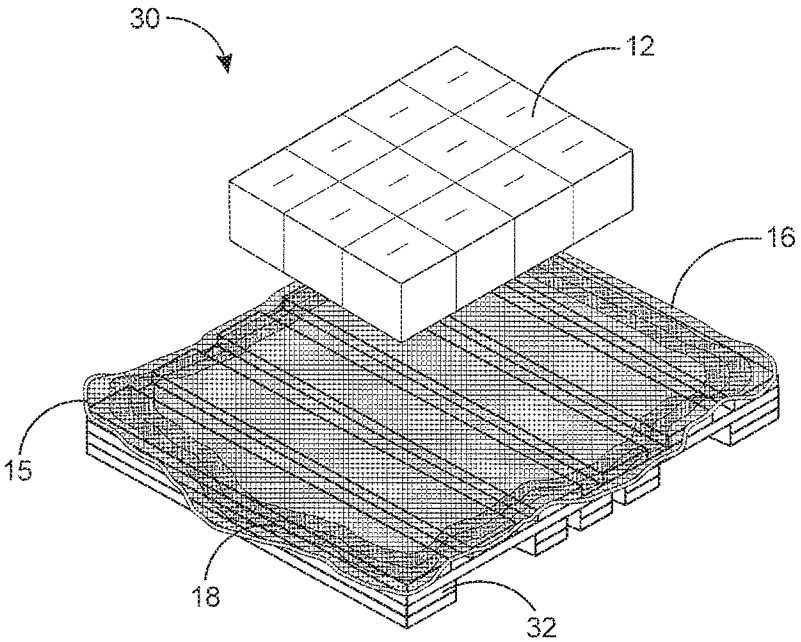
FIGS. 7B through 7D illustrate steps of the method for keeping insects out of pallet load shipments in accordance with the further embodiment of the present invention shown in FIG. 7A.
Figure 7A:
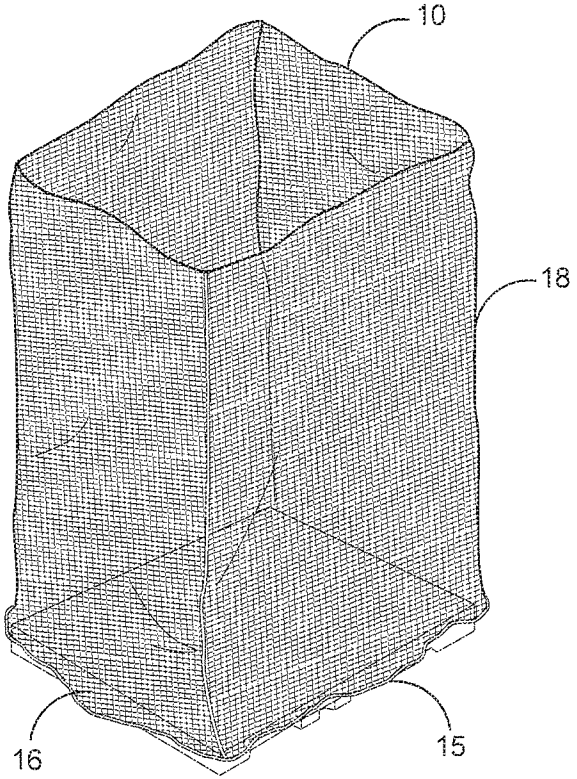
FIG. 7A is a perspective view of a further embodiment of the apparatus of the subject invention in an unsealed state.

FIG. 7A illustrates a further embodiment of the apparatus where top piece 18 has an open top and the height of the sides top piece 18 are sufficiently longer than the height of load 12 (not shown) being shipped such that the excess material top piece 18 that is longer than the height of load 12 can be gathered and cinched together at the top of load 12. Bottom sheet 16 is attached to top piece 18 by zipper 15.

Figure 7D:
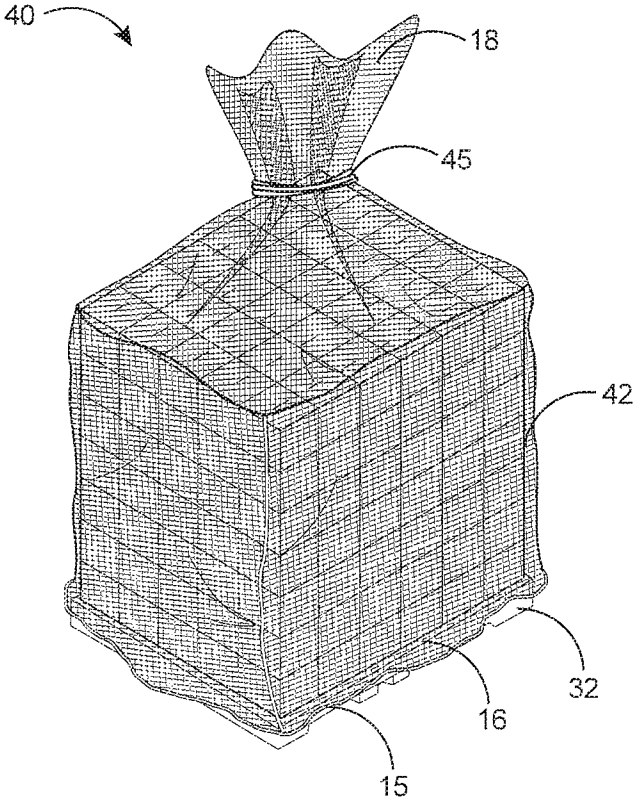
Figure 7C:
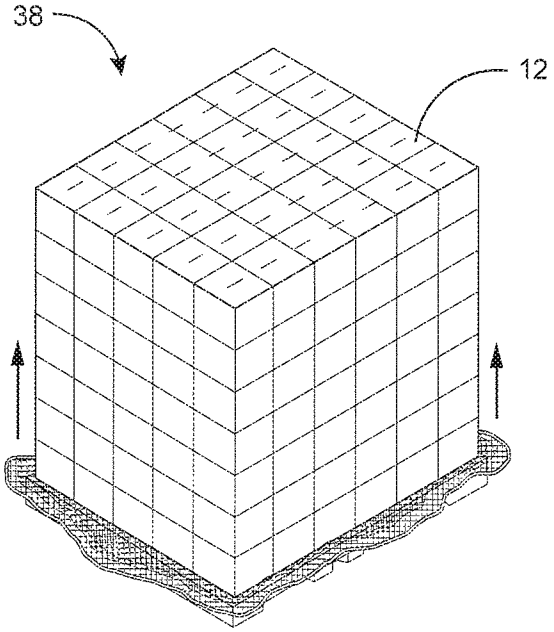

FIGS. 7B through 7D illustrate steps of the method of keeping insects out of pallet load shipments in accordance with a preferred embodiment shown in FIG. 7A. As illustrated in 7B, in step 30, bottom sheet 16 is attached to top piece 18 using zipper 15. Bottom sheet 16 is positioned on the pallet 32. The top piece 18 is positioned circumferentially around the pallet. In second step 36 (not shown), load 12 that has already been treated to remove or kill any insects that may be near or on the products in the load is stacked onto bottom sheet 16. Top piece 18 and bottom sheet 16 are already zipped together and do not need to be unzipped for this second step 36. Compare this to the earlier embodiment, wherein the top and bottom pieces also come zipped together, but they must be unzipped, then zipped back together to enclose the shipment load 12. In third step 38 illustrated in FIG. 7C, bag 10 is pulled up and excess material on the sides of top sheet 18 above the height of load 12 is gathered at the top. In fourth step 40, the gathered material is cinched and sealed closed using an additional sealing means 45, such as a zip tie. FIG. 7D illustrates the result of step 40, sealed load 42 that is ready for storage and shipping using the further embodiment of FIG. 7A. As shown in FIG. 7D, the excess material of top piece 18 is cinched at the top of load 12 and secured by additional sealing means 45. Securement means 24 (not shown) can be added if desired. Sealed load 42 can be transported into a shipping container for shipping to the desired destination.

When the sealed load 42 arrives at the receiving end of the shipment and/or destination, any securement means 24 are undone, zipper 15 is unzipped, and load 12 is unloaded. Alternatively, in a warehouse club store environment, any securement means 24 is undone, zipper 15 is unzipped, and top piece 18 is removed from load 12. Load 12 can be seen and bought by shoppers while bottom sheet 16 of bag 10 will remain on pallet until all products of load 12 are removed and/or purchased by shoppers. Bottom sheet 16 will lie on pallet 32 and is designed to be inconspicuous and not get in the way. Zipper 15 is put in its fully zipped state before placing load 12 into bag 10 and would only be unzipped when the shipment is opened at its final destination, or when bag 10 is reused.

SUMMARY AND SCOPE

Accordingly, the present invention is a method and apparatus for keeping insects out of pallet load shipments that have been fumigated and inspected for shipping using a one-piece or multi-piece bag, where all or a portion of the bag is made of screen, netting, or other porous or vented material. The holes in the porous material are small enough to prevent insects and other pests from reaching the load, but allow for sufficient air circulation and ventilation. Sealing and unsealing means are provided that allow for quick sealing of a pallet load, as well as quick removal of the bag upon reaching its shipping destination, allowing the pallet load to be accessible and easily inspected, and quickly converted to a display-ready load. The present invention eliminates the need to retreat the load should the shipping container that houses the pallet load shipments be opened prior to reaching its final destination. The present invention also allows the use of open top containers for shipping.

Although the description above contains many specificities, these should not be construed as limiting the scope of the invention but merely providing illustrations of some of the presently preferred embodiments of this invention. For example, the bag described can have other shapes such as circular, oval, rectangular, etc., the sealing means can include any sealing means known to those skilled in the art of packing and shipping, the invention can employ any variety of box or shipment containers, and the bag or enclosure can exhibit any configuration or combination of porous and impermeable materials.

Although some embodiments are shown to include certain features, it is specifically contemplated that any feature disclosed herein may be used together or in combination with any other feature on any embodiment of the invention. It is also contemplated that any feature may be specifically excluded from any embodiment of the invention.

As used herein, the following terms and variations thereof have the meanings given below, unless a different meaning is clearly intended by the context in which such term is used. "A," "an" and "the" and similar referents used herein are to be construed to cover both the singular and the plural unless their usage in context indicates otherwise.

"Comprise" and variations of the term, such as "comprising" and "comprises," are not intended to exclude other additives, components, integers or steps. "Exemplary," "illustrative," and "preferred" mean "another."

Unless otherwise indicated, all numbers, dimensions, materials and so forth used in the specification and claims are to be understood as being examples and not limitations, and in any event, not as an attempt to limit the application of the doctrine of equivalents to the scope of the claims.

All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of any claim. No language in the specification should be construed as indicating any non-claimed element essential to the practice of the invention.

Certain embodiments are described herein, including the best mode known to the inventor for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein.

Accordingly, the claims include all modifications and equivalents of the subject matter recited in the claims as permitted by applicable law. Moreover, any combination of the above-described elements in all possible variations thereof is contemplated unless otherwise indicated herein or otherwise clearly contradicted by context. The invention should therefore not be limited by the above described embodiment, method, and examples, but shall be deemed to include all embodiments, methods and equivalents within the scope and spirit of the invention as claimed.

I claim:

1. An apparatus for preventing insects and other pests from entering a load of goods comprising:

a shipping pallet;

a freely transportable shipping enclosure formed of separate connected panels releasably joined;

said panels having at least one section of porous venting material characterized by a small pore size that prevents the entry of small insects, with the pore size being large enough and said venting section(s) suitably positioned to allow the flow of ambient air into and out of said enclosure;

said panels joined such that there are no openings to said load larger than said pore size of said venting material;

said enclosure fully encapsulating said load and resting on top of said pallet;

said pallet, said enclosure, and said load of goods being freely transportable together as a unit, with said load encapsulated and protected by said enclosure; and said unit having no securement to the ground.

2. The apparatus of claim 1 wherein said venting material also allows parts of said load to be viewed.

3. The apparatus of claim 1 wherein said panels are formed of flexible material and said enclosure further comprises a means for sealing wherein the edges of said panels are attached one to the other using said means for sealing to completely enclose said load of goods.

4. The apparatus of claim 3 wherein said means for sealing is resealable and may be used more than once to sequentially seal said enclosure around a plurality of loads of goods.

5. The apparatus of claim 3 wherein said panels comprise a bottom piece placed under said load and an upper piece placed over said load that is sealed to said bottom piece by way of said means for sealing.

6. The apparatus of claim 3 wherein said panels comprise a bottom piece placed under said load and an upper piece open at the top placed over said load that is sealed to said bottom piece using said means for sealing, and said enclosure comprises an additional means for sealing used to close the open top of said upper piece.

7. The apparatus of claim 1 wherein at least one section of said enclosure is made of solid, impermeable material.

8. The apparatus of claim 7 wherein said section(s) of venting material of said enclosure are arranged on said enclosure so as not to come in touching contact with said goods when the goods are enclosed within said enclosure.

9. The apparatus of claim 3 wherein said means for sealing is selected from a group consisting of zippers, hook and loop fasteners, snaps, buttons, tape, glue, staples, stitching, tacks, nails, screws, or any combination thereof.

10. The apparatus of claim 3 further comprising a tamper evident indicator in touching communication with said means for sealing to identify if said means for sealing has been opened and to discourage accidental or unauthorized opening.

11. The apparatus of claim 1 further comprising one or more cinctures to secure said enclosure around said load.

12. The apparatus of claim 11, wherein said cincture is selected from a group consisting of elastic, rope, string, tape, and stretch wrap.

13. The apparatus of claim 1 further comprising a means for securing said load from damage during said storage and transport.

14. The apparatus of claim 13 wherein said means for securing said load is selected from a group consisting of a top cover, corner guards, twine, rope, and stretch-netting.

15. The apparatus of claim 1 further comprising document holders affixed to the outside of said enclosure for holding shipping documents.

16. The apparatus of claim 1 wherein said load of goods comprise one or more containers of goods.

17. The apparatus of claim 6, wherein said additional means for sealing also cinches closed said open top of said upper piece and is selected from a group consisting of zippers, hook and loop fasteners, snaps, buttons, tape, glue, staples, stitching, tacks, nails, screws, zip ties or any combination thereof.

18. An apparatus for preventing insects and other pests from entering a load of goods placed on a pallet comprising:

a shipping pallet;

a freely transportable shipping enclosure formed of separable connected panels releasably joined;

said panels having at least one section made of porous venting material characterized by a small pore size that prevents the entry of small insect, with the pore size being large enough and said venting section(s) suitably positioned to allow the flow of ambient air into and out of said enclosure;

said panels joined such that there are no openings to said load larger than said pore size of said venting material;

said enclosure fully encapsulating said load and said pallet, including the top and bottom of said load with pallet;

said enclosure and said load with pallet being freely transportable together as a unit;

said enclosure receiving, holding, sealing, protecting, and fully encapsulating said load and pallet while being transported; and said unit having no securement to the ground.

* * * * *